US011465028B2

(12) United States Patent
Leznik

(10) Patent No.: US 11,465,028 B2
(45) Date of Patent: Oct. 11, 2022

(54) PUNCHING/BOXING/MARTIAL ARTS BAG SYSTEM

(71) Applicant: Eden Leznik, Belmont, CA (US)

(72) Inventor: Eden Leznik, Belmont, CA (US)

( * ) Notice: Subject to any disclaimer, the term of this patent is extended or adjusted under 35 U.S.C. 154(b) by 0 days.

(21) Appl. No.: 16/453,483

(22) Filed: Jun. 26, 2019

(65) Prior Publication Data

US 2020/0016473 A1 Jan. 16, 2020

Related U.S. Application Data

(60) Provisional application No. 62/689,929, filed on Jun. 26, 2018.

(51) Int. Cl.
*A63B 71/02* (2006.01)
*A63B 69/20* (2006.01)

(52) U.S. Cl.
CPC ..... *A63B 71/023* (2013.01); *A63B 69/201* (2013.01); *A63B 2209/00* (2013.01)

(58) Field of Classification Search
CPC ..... A63B 71/023; A63B 69/20; A63B 69/201; A63B 69/203; A63B 69/205; A63B 69/206; A63B 69/208; A63B 69/24; A63B 2209/00; A63B 2071/0602; A63B 1/00; A63B 2244/102; A63B 2244/10–106; A63B 69/32–34
See application file for complete search history.

(56) References Cited

U.S. PATENT DOCUMENTS

| | | | | |
|---|---|---|---|---|
| 3,337,217 | A * | 8/1967 | Cummins | A63B 69/345 473/442 |
| 4,941,660 | A * | 7/1990 | Winn | A63B 21/0602 273/454 |
| 8,876,671 | B1 * | 11/2014 | Hurtato, Jr. | A63B 69/24 482/87 |
| 9,486,686 | B2 * | 11/2016 | Haselrig | A63B 69/20 |
| 9,586,120 | B1 * | 3/2017 | Sotelo | A63H 13/06 |
| 2004/0097348 | A1 * | 5/2004 | Laudenslager | A63B 69/201 482/86 |
| 2008/0096733 | A1 * | 4/2008 | Epstein | A63B 69/201 482/83 |

(Continued)

FOREIGN PATENT DOCUMENTS

| | | | | |
|---|---|---|---|---|
| GB | 518988 | A * | 3/1940 | A63B 69/201 |

OTHER PUBLICATIONS

Screen captures from YouTube video clip entitled "V'NOKS Gel Yellow 12-15 KG Kids Punch Bag," 5 pages, uploaded on Jul. 18, 2017 by user "V'NOKS professional gear". Retrieved from Internet: https://www.youtube.com/watch?v=OEAVz8jshhc (Year: 2017).*

(Continued)

*Primary Examiner* — Garrett K Atkinson
*Assistant Examiner* — Kathleen M Fisk
(74) *Attorney, Agent, or Firm* — Vierra Magen Marcus LLP

(57) ABSTRACT

A system for supporting a punching bag includes a bag portion mounted on a ring by straps. The ring is spaced away from the bag portion by the straps. The ring is in turn mounted by springs or chain to a plate and bearing assembly including a plate. The ring is the same circumference as the bag portion. As such, the straps are vertical. This prevents deformation of the bag.

12 Claims, 9 Drawing Sheets

(56) References Cited

U.S. PATENT DOCUMENTS

| | | | | |
|---|---|---|---|---|
| 2010/0032544 | A1* | 2/2010 | Tsakiris | F16F 1/128<br>248/610 |
| 2010/0227743 | A1* | 9/2010 | Jutte | A63B 69/201<br>482/87 |
| 2010/0261584 | A1* | 10/2010 | Tsakiris | A63B 69/201<br>482/86 |
| 2017/0333774 | A1* | 11/2017 | Bartron | A63B 69/24 |

OTHER PUBLICATIONS

Screen captures from YouTube video clip entitled "The Best Type of Boxing Bag," 3 pages, uploaded on Jun. 18, 2017 by user "Nick Zier". Retrieved from Internet: https://www.youtube.com/watch?v=cPw-geKrdSQ (Year: 2017).*

* cited by examiner

PUNCHING/BOXING/MARTIAL ARTS BAG SYSTEM

CLAIM OF PRIORITY

This application claims priority to U.S. Provisional Patent Application No. 62/689,929 entitled "Punching/Boxing/Martial Arts Bag System" filed on Jun. 26, 2018, which application is incorporated herein in its entirety.

BACKGROUND

Field of Invention

This invention relates to the way a punching, martial arts, or boxing bag is made. Particularly, this invention relates to the holding mechanisms, quality, and strap mechanisms of the bag. More particularly, the systems related to allowing the bag to be safer and longer lasting. The invention is also further applicable to sewing techniques in leather and synthetic bags. Springs and ball bearing devices are related to the field of invention.

Description of Related Art

The current state of punching bags are made out of one piece of material. These bags models made are made out of PVC tarp material, artificial leather, or leather that is under 2.5 mm thick. The straps mechanism do not have a holding mechanism included. The strap mechanism includes metal chains, PVC tarp material connected to D-Rings, or no hanging method at all. The punching bags are also stuffed with garbage, sand, and large pieces of clothing. Today's logos are printed or stitched onto the punching area of the bag.

SUMMARY

The bag is made out of the upper section, lower section, and a holding mechanism. The lower section of the bag is made for hitting and is stuffed with inch by inch cotton and soft fabric materials. The upper section of the bag is made for the logo, stuffed with leather, and is restricted for the logo. The strap mechanism is made with two straps and backing material. The holding mechanism is made to help absorb hits and to tell the user if the hits are landing flush.

DETAILED DESCRIPTION

Figure 1:
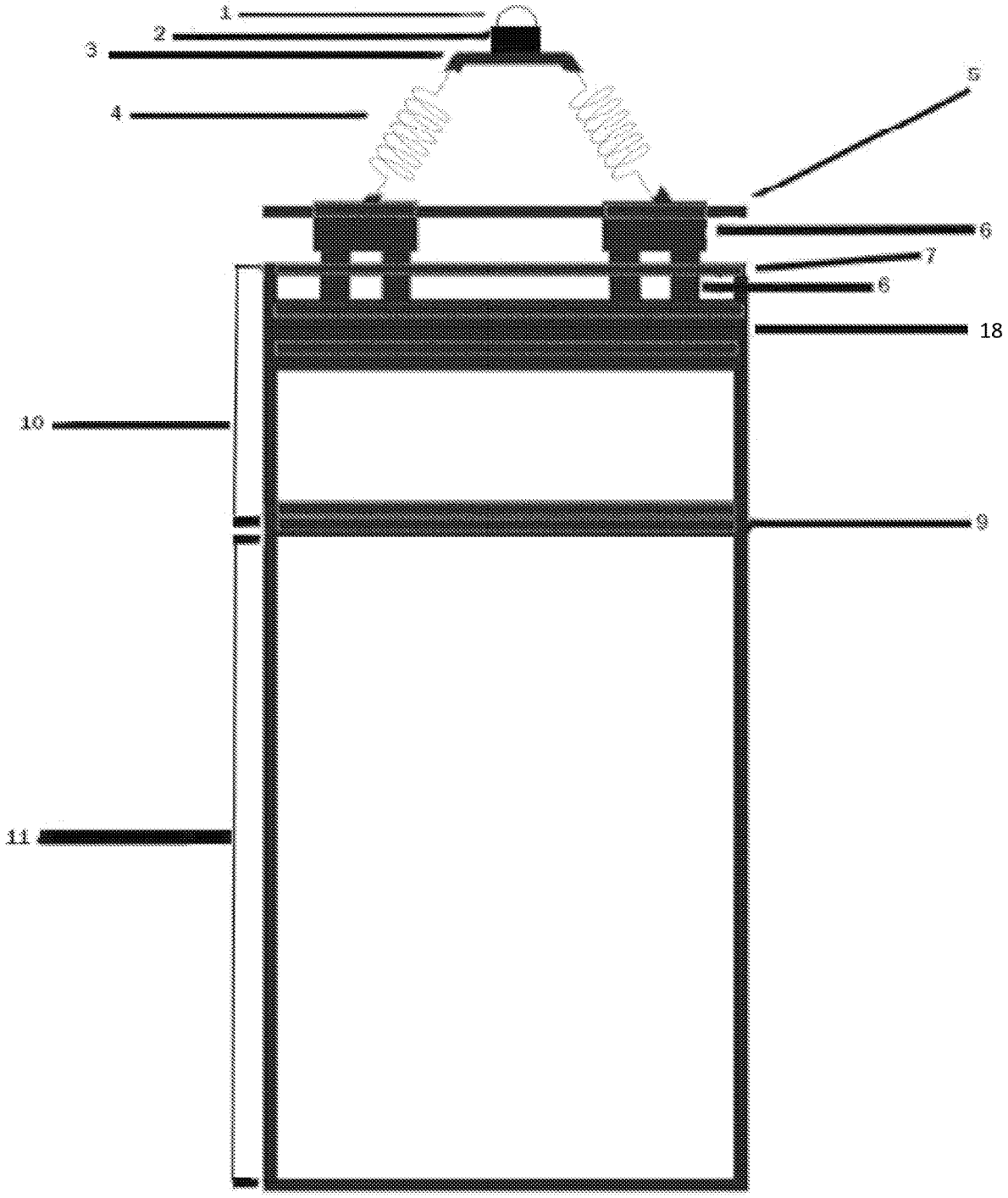
FIG. 1 shows the invention, with different unique sections labeled, all together.

FIG. 1 shows what is included in the bag. FIG. 1 Elements 1-6 shows the holding mechanism of the boxing bag. FIG. 1 Element 7 shows the top cap attachment area in a bag. FIG. 1 Element 6 shows the strap mechanism. FIG. 1 Elements 9-11 show the main parts of the hag.

Figure 8:
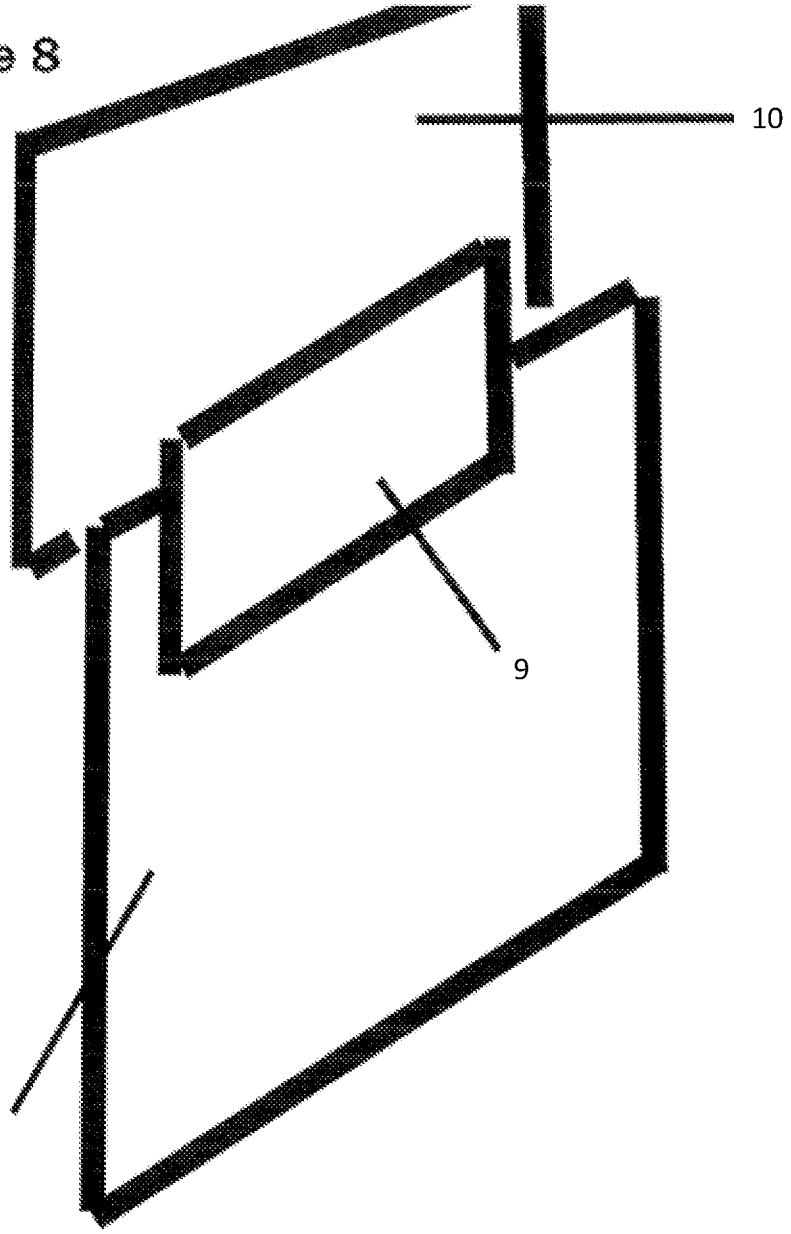
FIG. 8 shows how the upper section of the bag is sewn to the lower section of the bag and is then covered by a belt.
Figure 9:
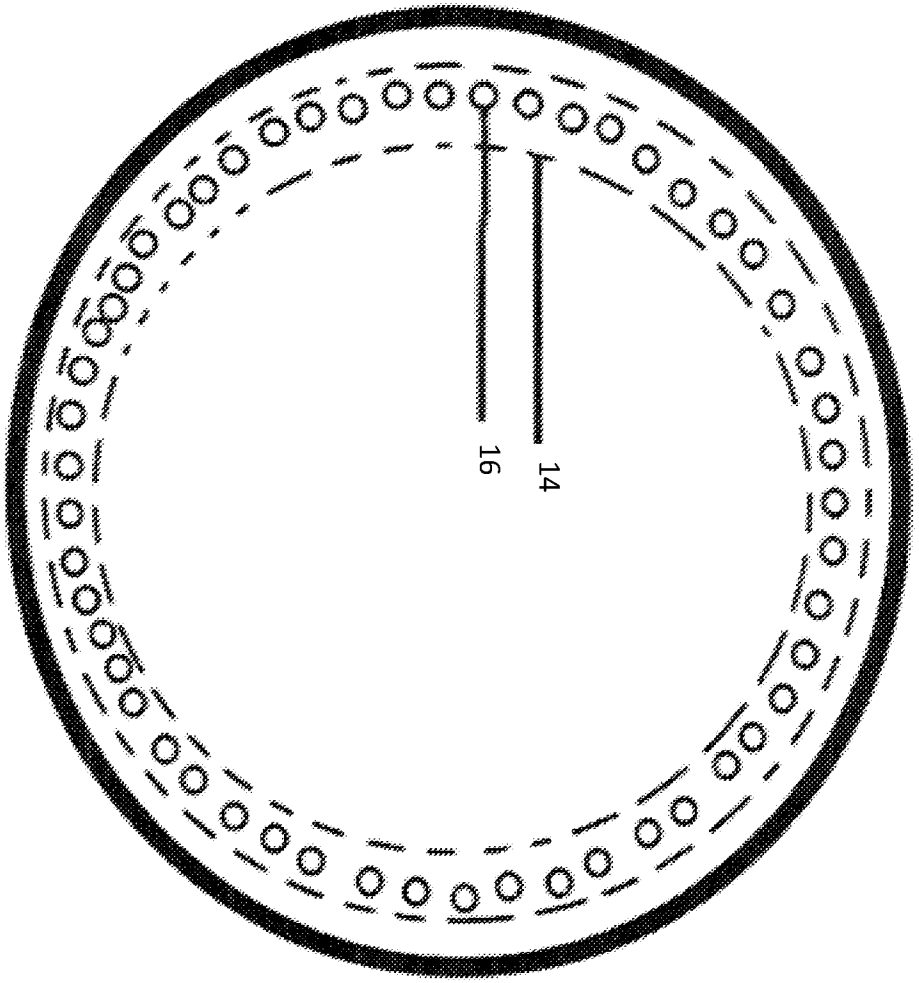
FIG. 9 shows a birds eye view of the top cap mechanism.

FIG. 1 Elements 9-11 show the main parts of the bag. In FIG. 8 it is shown how the sections of the bag are sewn together. First. FIG. 8 Element 11 is placed over part of FIG. 1 Element 10 and sewn together with two sewing lines. Then, FIG. 1 Element 9 is sewn over the connecting area of FIG. 8 Elements 10. There are 4 sewing lines total in Element 9 of the bag. Of the total 4 sewing lines, FIG. 8 Element 9 has one sewing line connecting with FIG. 8 Element 10. Then FIG. 8 Element 9 has 2 sewing lines with the overlapping area of FIG. 8 Element 11. Lastly, FIG. 8 Element 9 has one last sewing line with FIG. 8 Element 11. This is made to make sure that the upper and lower sections of the bags are connected well. FIG. 1 Element 11, is the hitting area (lower section) of the hag. This area is filled with inch by inch cut stuffing material that contains bits of cotton and fabrics that are soft. FIG. 1 Element 10 is the upper bag section. The upper bag section is made out of different materials and that is where the logo of the company is placed. The person hitting the bag does not hit the upper section. The upper section of the bag is filled with leather bits, that are heavier than material stuffed in the hitting section of the bag.

Figure 5:
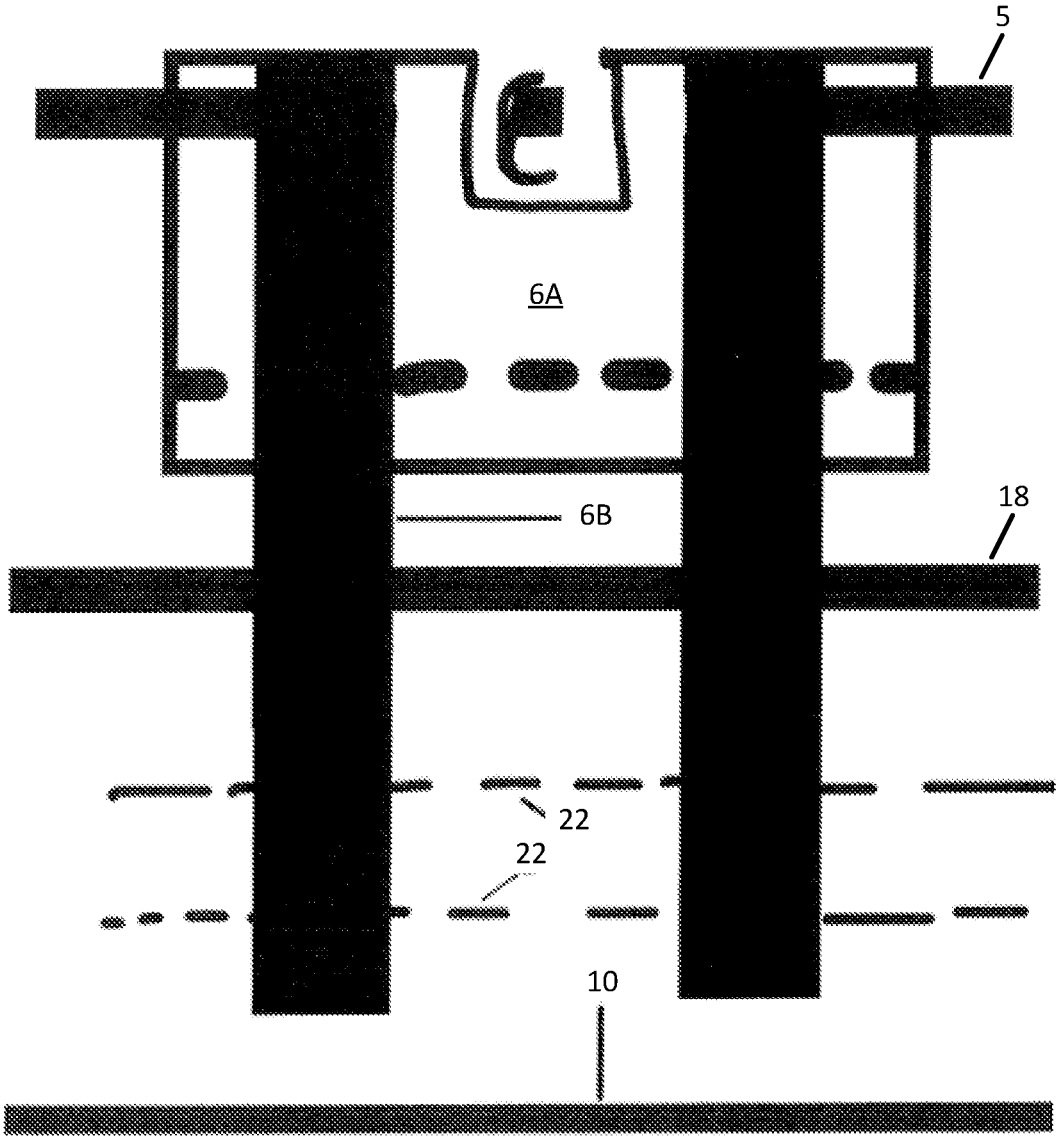
FIG. 5 shows the strap mechanism sewn to the upper section of the bag.
Figure 6:
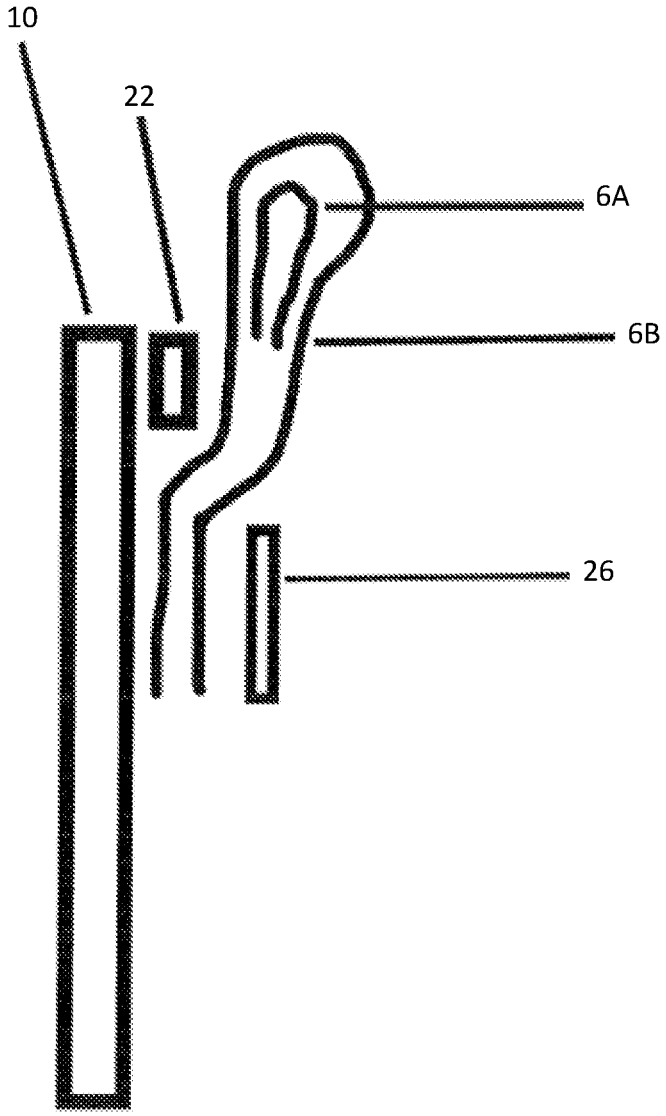
FIG. 6 shows a side view, of the strap mechanism, sewn to the upper section of the bag covered with leather belt.
Figure 7:
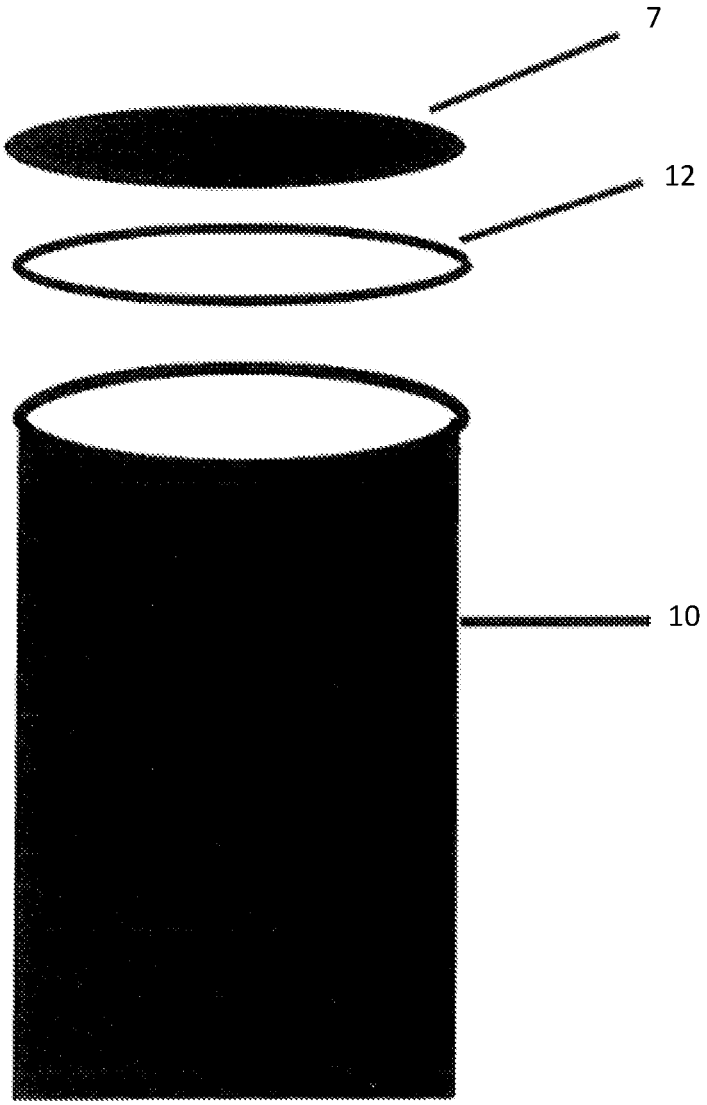
FIG. 7 shows how the top cap of the bag is tightened to the upper section of the bag.

The attachment of the top cap 7 of the bag to the main part of the bag is shown described in FIG. 5, FIG. 6, FIG. 7, and FIG. 9. In FIG. 7 Element 7 is the top cap for the bag. FIG. 7, top cap 7 is then attached to an Element 12 shown as a ring in FIG. 7 with two sewing lines shown in FIG. 9 Element 14. Element 12 is 1" wide×3 mm in height×the length matches the circumference of the uppermost part of the hag. After the top cap 7 is assembled it is attached by passing a rope 16 through holes in the top cap (FIG. 9) to holes in FIG. 6 Elements 10 and 18. In FIG. 6 the upper section 10 of the bag is sewn with a belt 18. FIGS. 1 and 6 Element 18 is a belt that is 1" in width×3 mm in width×the circumference of the bag as length. FIG. 5 shows the belt 18 attached to the upper section of the bag with two sewing lines and holes made to attach the top cap in order to close the bag. The backing gives the bag a total of 6 mm thick leather backing for strength where the top cap and upper are of the hag meet. This added protection lets the bags be tied together by a rope without ripping through the leather. In term the bags can be tied down tighter.

Figure 2:
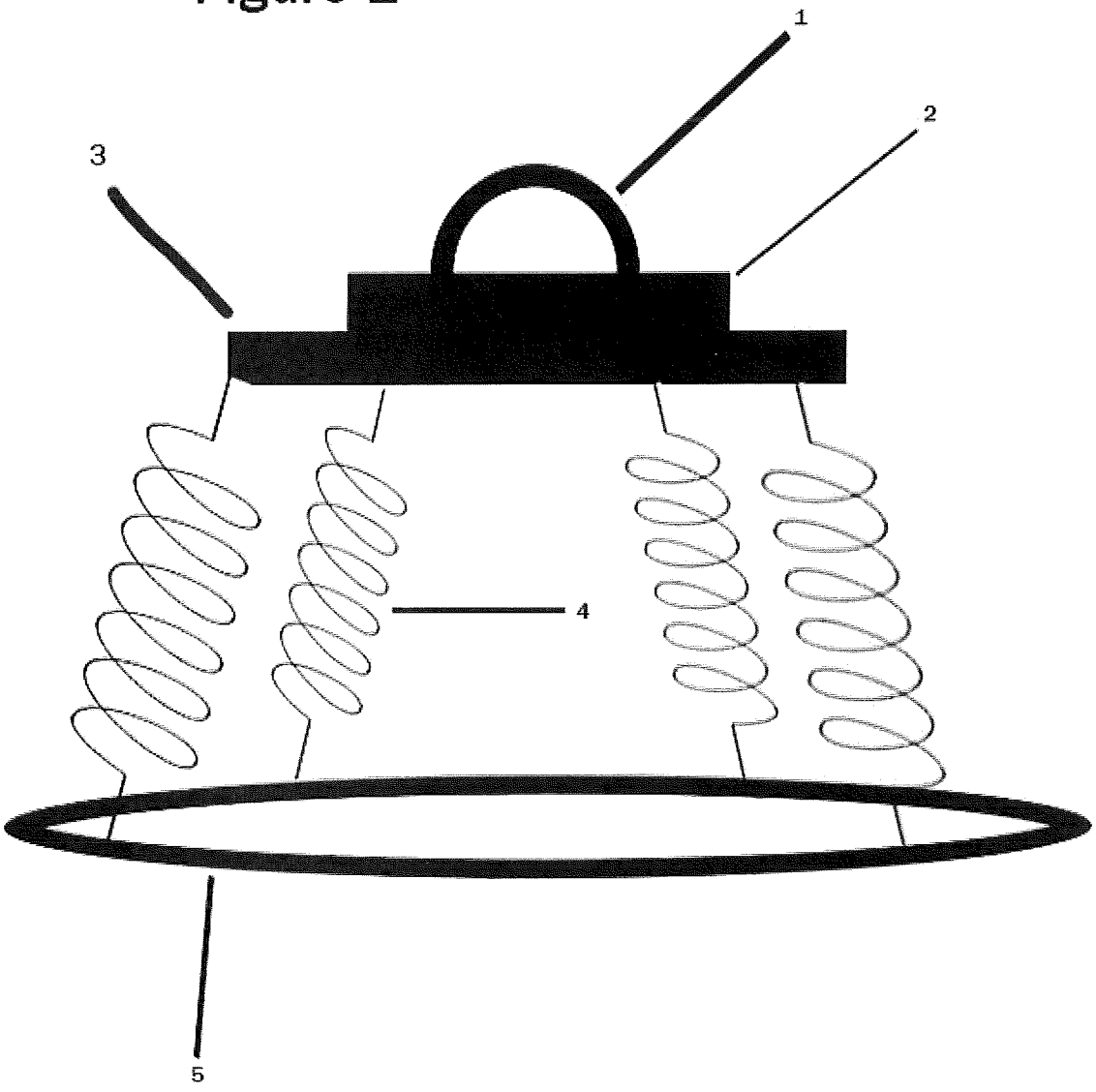
FIG. 2 shows the bag holding mechanism.

A holding mechanism allows the punches to be absorbed taking pressure of the person's punching wrists. The holding mechanism, which may also be referred to herein as a plate and bearing assembly, is found in FIGS. 1 and 2. The holding mechanism also allows the punching bags weight to be evenly placed through the boxing bag. The holding mechanism allows the punching bag to tell the person if they are landing flush punches because it spins if the punches do not land directly on the bag. The holding mechanism starts with FIG. 2 Element 1. FIG. 2 Element 1 shows a D-Ring attached to a metal mechanism 2 which allows the bag to spin freely if the punches are not landing flush. The D-Ring is mounted to a support (not shown) and carries the whole weight of the boxing bag. The D-Ring is attached to metal mechanism 2. FIG. 2, metal mechanism 2 shows the mechanism that allows the bag to tell the person using it if their hits are landing flush. The mechanism 2 has the ability to spin freely as it has a ball bearing inside. If a person is hitting the bag correctly it should not spin. When hits land indirectly on the bag the ball bearing start to spin as the hit is not centered on the bag. The ball bearing in metal mechanism 2 on FIG. 2 is attached to the Metal Holding Plate 3. The Metal Holding Plate 3 found in FIG. 2 is responsible for being attached to the ball bearings of the metal mechanism 2, and holding the springs (FIG. 2, Elements 4.) Four to six holes are drilled in the metal plate 3 depending on the weight of bag. The metal holding plate 3 holds up the Springs 4. Trampoline style springs 4 on the holding mechanism can be found on FIG. 2. These are needed in order to absorb the punches of boxers. The springs, when in motion, also imitates a motion of a fighter. If the bag is heavier metal chains, instead of springs, help hold up heavier models of bags. FIG. 2 Element 5 shows a metal ring that the springs or metal chains attach to help weight distribution of the bag. The metal ring 5 helps weight distribution along the hag by keeping the strap mechanism 6 (FIG. 5) in a vertical position. This prevents the straps 6 which hold the bag to point inwards. Inward facing straps on bags means that the weight of the bag is displaced in the upper section. The weight being displaced because of strap mechanism facing inwards causes the bag to lose its original shape because the stuffing would exert pressure on the material to rip the bag. This support structure is unique and keeps the bag from deforming, losing shape, and tearing.

Figure 3:
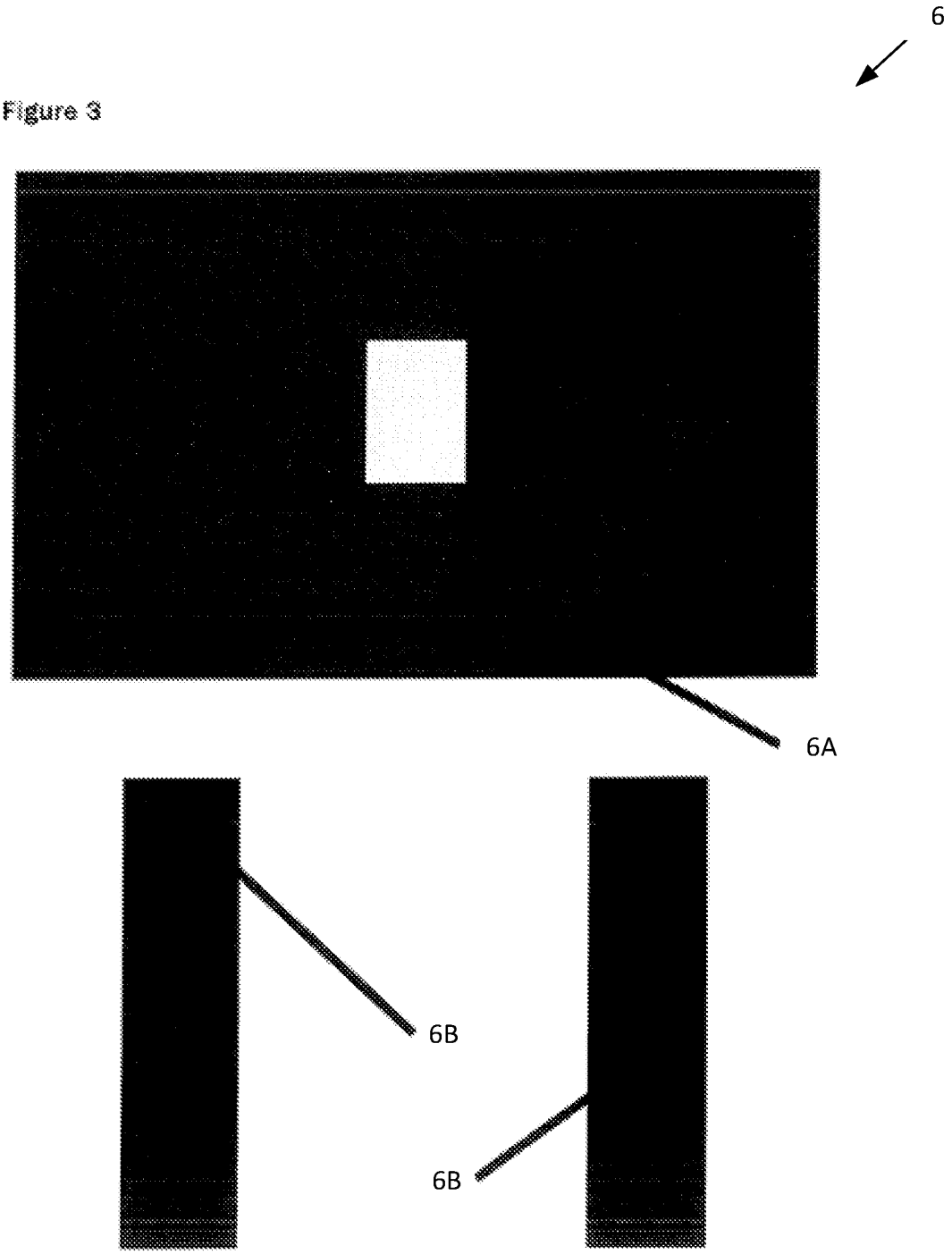
FIG. 3 shows the makeup of the strap mechanism.
Figure 4:
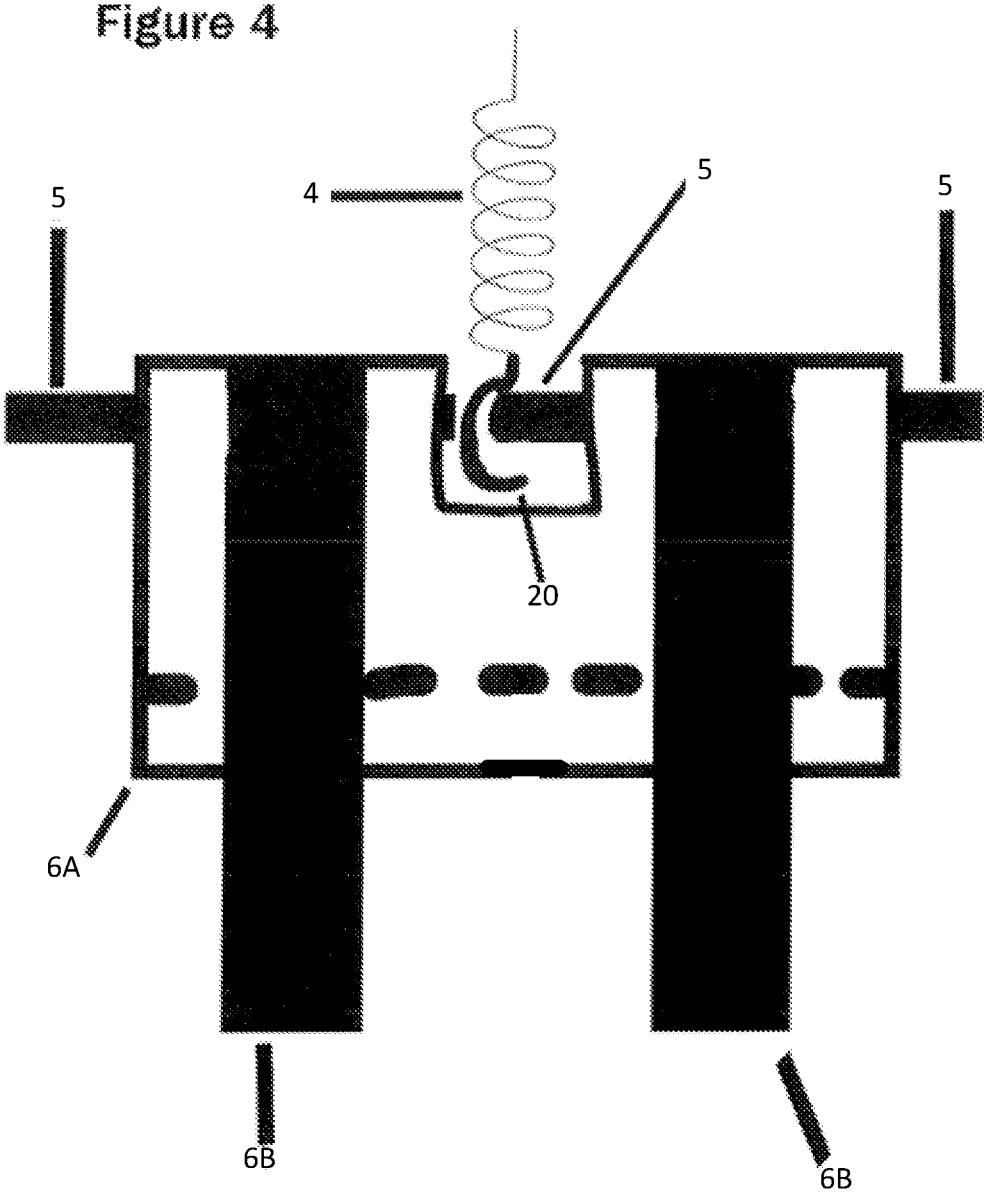
FIG. 4 shows the strap mechanism attached to the holding mechanism.

The strap mechanism 6 is explained in FIGS. 3-6 and FIG. 8. FIG. 3 shows that the strap mechanism is made out of two parts Element 6A and Element 6B. FIG. 3 Element 6A is the backing for the strap material 6B. The hacking has a rectangle shape, with a cut out rectangle in the middle of the backing. The strap mechanism backing 6A has the purpose of acting as protection for the two straps 6B. The two straps shown in FIG. 3 are responsible for holding up the hag. Each strap mechanism 6 is made up of one backing piece 6A and two straps 6B. FIG. 4 shows the strap mechanism is sewn and is attached to the holding mechanism. First the strap mechanism backing 6A is folded in half. Then the two straps 6B are placed over the backing. A side view of the strap mechanism 6 is shown in FIG. 6. FIG. 6 Element 6A is the backing of the strap mechanism. FIG. 6 Element 6B is the straps which are placed over the backing. The metal ring 5 of the holding mechanism is then passed through the gap of the backing 6B. The springs 4 of the holding mechanism are attached to the metal ring 5 in the place where the strap mechanism hacking 6B has an opening (shown at 20 in FIG. 4). FIG. 5 shows how the strap mechanism 6 is attached to the upper bag area 10. FIG. 5 shows the strap mechanism 6 is placed over the upper area 10 of the bag. The strap mechanism is then sewed to the upper area of the hag with two sewing lines shown in FIG. 5 Element 22. FIG. 6 shows a side view that after the strap mechanism is sewed to the upper area of the bag. It is then sewn over with another piece of 3 mm leather 26 the length of the circumference of the bag in order to further more attach the straps to the boxing bag. The leather 26 used in this bag is 3 mm and allows the bag gloves not to damaged. The logo of the bag is laser engraved onto the bag. This makes sure that the logo is not erased. The logo can also be stamped onto the bag which makes the bag logo last without getting wiped off by hits. All logo areas are placed in the upper section of the bag where they cannot be hit.

What is claimed is:

1. A system for supporting a punching bag, comprising:

a bag portion having a circumference and a central axis of rotation;

strap mechanisms comprising first and second straps, the first and second straps each comprising:

first ends connected to the bag portion at the circumference and second ends, opposite the first ends, extending upward from the bag portion and spaced vertically above an uppermost portion of the bag portion in a direction parallel to the central axis of rotation, and a folded backing comprising a cutout, the second ends of the first and second straps wrapped around the folded backing on either side of the cutout;

a ring engaged through the folded backing and the second ends of the first and second straps with the folded backing folded around the ring and the second ends of the first and second straps folded around the folded backing, the ring spaced vertically above the uppermost portion of the bag portion in the direction parallel to the central axis of rotation, the strap mechanisms extending in vertical planes between the bag portion and the ring; and a plate and bearing assembly comprising a plate configured to mount the punching bag to a support, the ring supported off of the plate.

2. The system of claim 1, wherein the system further comprises springs mounted between the plate and the ring.

3. The system of claim 2, wherein the springs angle inward from a first end connected to the ring and a second end opposite their first end connected to the plate.

4. The system of claim 2, wherein the springs are configured to enable the bag portion to spring back toward a person punching the punching bag after being hit by a punch to imitate movements of an opponent.

5. The system of claim 2, wherein the plate and bearing assembly comprises bearings, the bearings configured to allow the plate, springs, and the bag portion affixed to the springs, to rotate relative to the support about the central axis of rotation.

6. The system of claim 1, further comprising chains mounted between the plate and bearing assembly and the ring.

7. The system of claim 6, wherein the chains angle inward from a first end connected to the ring and a second end opposite their first end.

8. The system of claim 6, wherein the plate and bearing assembly comprises bearings, the bearings configured to allow the plate, chains, and the bag portion affixed to the chains, to rotate relative to the support.

9. The system of claim 1, wherein the ring has a circumference equal to the circumference of the bag portion.

10. A system for supporting a punching bag, comprising:

a bag portion having a circumference and a central axis of rotation;

first and second straps each comprising:

first ends connected to the bag portion at the circumference and second ends opposite the first ends, the second ends extending upward from the bag portion and spaced vertically above an uppermost portion of the bag portion in a direction parallel to the central axis of rotation, and a folded backing comprising a cutout, the second ends of the first and second straps wrapped around the folded backing on either side of the cutout;

a ring affixed to the folded backing and the second ends of the first and second straps with the folded backing folded around the ring and the second ends of the first and second straps folded around the folded backing, the ring spaced vertically above the uppermost portion of the bag portion in the direction parallel to the central axis of rotation, the first and second straps extending in vertical planes between the bag portion and the ring;

a plate and bearing assembly configured to support the punching bag on a support mounted above the punching bag;

one of springs or chains affixed between the ring and the plate and bearing assembly.

11. The system of claim 10, wherein the ring has a circumference equal to the circumference of the bag portion.

12. The system of claim 10, wherein the plate and bearing assembly further comprises bearings, the bearings configured to allow the bag portion to rotate relative to the support.

* * * * *